US007828306B2

(12) United States Patent
Stratton

(10) Patent No.: US 7,828,306 B2
(45) Date of Patent: Nov. 9, 2010

(54) SKATEBOARD TRUCK WITH AN OFFSET AXLE

(76) Inventor: Neil Stratton, 706 6th Ave., Venice, CA (US) 90291

( * ) Notice: Subject to any disclaimer, the term of this patent is extended or adjusted under 35 U.S.C. 154(b) by 418 days.

(21) Appl. No.: 12/080,342

(22) Filed: Apr. 2, 2008

(65) Prior Publication Data

US 2009/0250891 A1 Oct. 8, 2009

(51) Int. Cl.
*B62M 1/00* (2010.01)

(52) U.S. Cl. ..... 280/87.042

(58) Field of Classification Search ..... 280/11.223, 280/11.27, 11.23, 11.26, 87.03, 87.041–43, 280/87.029, 47.12, 47.15, 11.19, 809; 301/125; *A63C 17/01*

See application file for complete search history.

(56) References Cited

U.S. PATENT DOCUMENTS 5,263,725 A * 11/1993 Gesmer et al. ..... 280/11.28
6,056,302 A * 5/2000 Smith ..... 280/87.042
6,105,978 A * 8/2000 Vuerchoz ..... 280/11.27
6,474,666 B1 * 11/2002 Andersen et al. ..... 280/87.041

FOREIGN PATENT DOCUMENTS

DE 19528579 C1 * 2/1997

* cited by examiner

*Primary Examiner*—J. Allen Shriver, II
*Assistant Examiner*—James Triggs
(74) *Attorney, Agent, or Firm*—Tope-McKay & Associates; Marcus Risso

(57) ABSTRACT

A skateboard truck with an offset axle is described. The skateboard truck includes a base plate and a kingpin attached with the base plate. A hanger is also attached with the base plate by the kingpin. The hanger includes an axle pin cast therein. The axle pin has a center axis and an arched portion and is positioned through the hanger such that the center axis of the axle pin passes through the kingpin, with the arched portion passing around the kingpin, thereby offsetting the axle pin and providing additional strength to the skateboard truck.

4 Claims, 3 Drawing Sheets

SKATEBOARD TRUCK WITH AN OFFSET AXLE

PRIORITY CLAIM

The present application is a non-provisional patent application, claiming the benefit of priority of U.S. Provisional Application No. 60/920,940, filed on Mar. 30, 2007, titled, "Skateboard Truck with an Offset Axle."

BACKGROUND OF THE INVENTION (1) Field of Invention

The present invention relates to a skateboard truck and, more particularly, to a skateboard truck having an offset axle design.

(2) Description of Related Art

The present application relates to a skateboard truck with an offset axle design. Offset axle geometry has been used primarily in slalom racing because of the sharp turning radius enabled by the special juxtaposition of the axle to the kingpin. This design is almost always referred to as a 'split-axle' truck. In order to achieve this configuration (i.e., 'split-axle'), the axle cannot pass through the kingpin, so it is split into two smaller axles on either side of the hangar, thus weakening the truck. Further weakening the truck is the fact that the axle halves are mechanically fastened into a machined hole rather than cast into it. The demands placed on the truck by old school specialty slalom skating do not typically exceed the strength of this hangar. However, for more aggressive styles of street skating, this design is simply not strong enough. One of the reasons this style of truck has never reached mainstream success is because breakage was so common in early split-axle designs that the design was much maligned and duly phased out.

For many years, mainstream skating went in a different direction, focusing on the airborne possibilities of the Ollie. As a result, trucks got tighter to facilitate landing, and the properties of the split-axle design became irrelevant. However, there is now a growing movement towards blending elements of current skating with the old-school surf influences into a new hybrid style, mirroring the evolution of surfing and its converse introduction of skate moves back to the wave. While there is now a need for the turning properties of the split-axle truck, the existing structural weaknesses still prevent its' reintroduction into the market.

Thus, a continuing need exists for a split-axle style truck without the structural deficiencies present in the prior art.

SUMMARY OF INVENTION

The present invention relates to skateboard truck with an offset axle. The skateboard truck includes a base plate and a kingpin attached with the base plate. A hanger is also attached with the base plate by the kingpin. The hanger includes an axle pin cast therein. The axle pin has a center axis and an arched portion and is positioned through the hanger such that the center axis of the axle pin passes through the kingpin, with the arched portion passing around the kingpin, thereby offsetting the axle pin and providing additional strength to the skateboard truck.

Finally, as can be appreciated by one in the art, the present invention also comprises a method for forming and using the truck described herein.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

Figure 1:
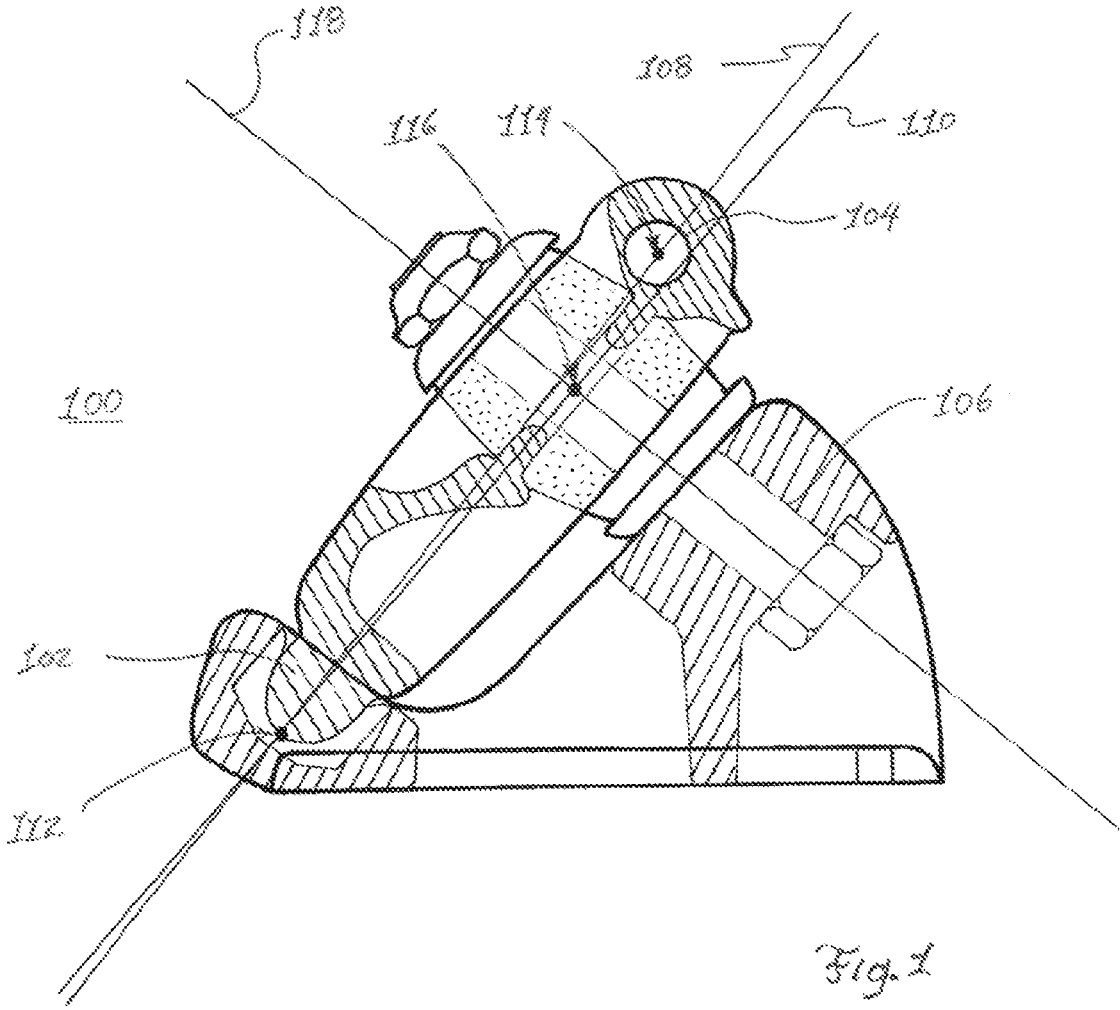
Fig. 1 (Prior Art)
FIG. 1 is a cross-sectional view illustration of a traditional truck.

The present invention relates to a skateboard truck and, more particularly, to a skateboard truck having an offset axle design. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1) Description

The present invention relates to a skateboard truck having an offset axle design. As discussed above, producing an offset axle skateboard truck has traditionally created a variety of structural deficiencies. The solution as put forth by the present invention is to bend a straight axle around the kingpin, providing the continuous structural support through the hanger while positioning the axle ends in the 'offset-axle' position. This also allows that the axle be sand-cast in, allowing the use of stronger alloys (e.g., 356) not fluid enough to be injection molded, and utilizing cooling shrinkage and adhesion to increase overall part strength.

One of the difficulties in manufacturing this solution is that the axle no longer sits straight in the sand, but now has a cantilevered bend that wants to collapse in the mold. Typically, axles are surrounded by the aluminum of the hangar to provide ample material to support it. A deterrent in easily implementing any kind of bent axle configuration is solving how to suspend the part in the mold while still embedding it firmly in the casting. Part of the solution put forth herein is to expose a small portion of the underside of the center of the bent axle so as to create a positive in the mold that will support that cantilevered bend.

Beyond the structural issues that the present invention solves, the visual common sense of this design will communicate to skaters in the marketplace the way in which this configuration addresses their demands for strength and tighter turns.

Before understanding the advantages of the present invention, it is helpful to understand the anatomy of a traditional skateboard truck. As shown in FIG. 1, a traditional skateboard truck, 100 uses a pin 102, a kingpin 106, and axle 104, with a kingpin axis 118 that is positioned substantially perpendicular to a pin-to-axle axis 108 and nearly parallel to a pin-to-bushing plate axis 110. The pin-to-axle axis 108 runs from a tip 112 of the pin 102 through a midpoint 114 of the axle 104. The pin-to-bushing plate axis 110 runs from a tip 112 of the pin 102 through a midpoint 116 of kingpin 106. While functional, the prior art produces a relatively limited degree of turn. When a user focuses weight on one edge of the skateboard (i.e., as opposed to the other edge) the truck will produce a twisting turn, which turns the skateboard in the desired direction.

Figure 2:
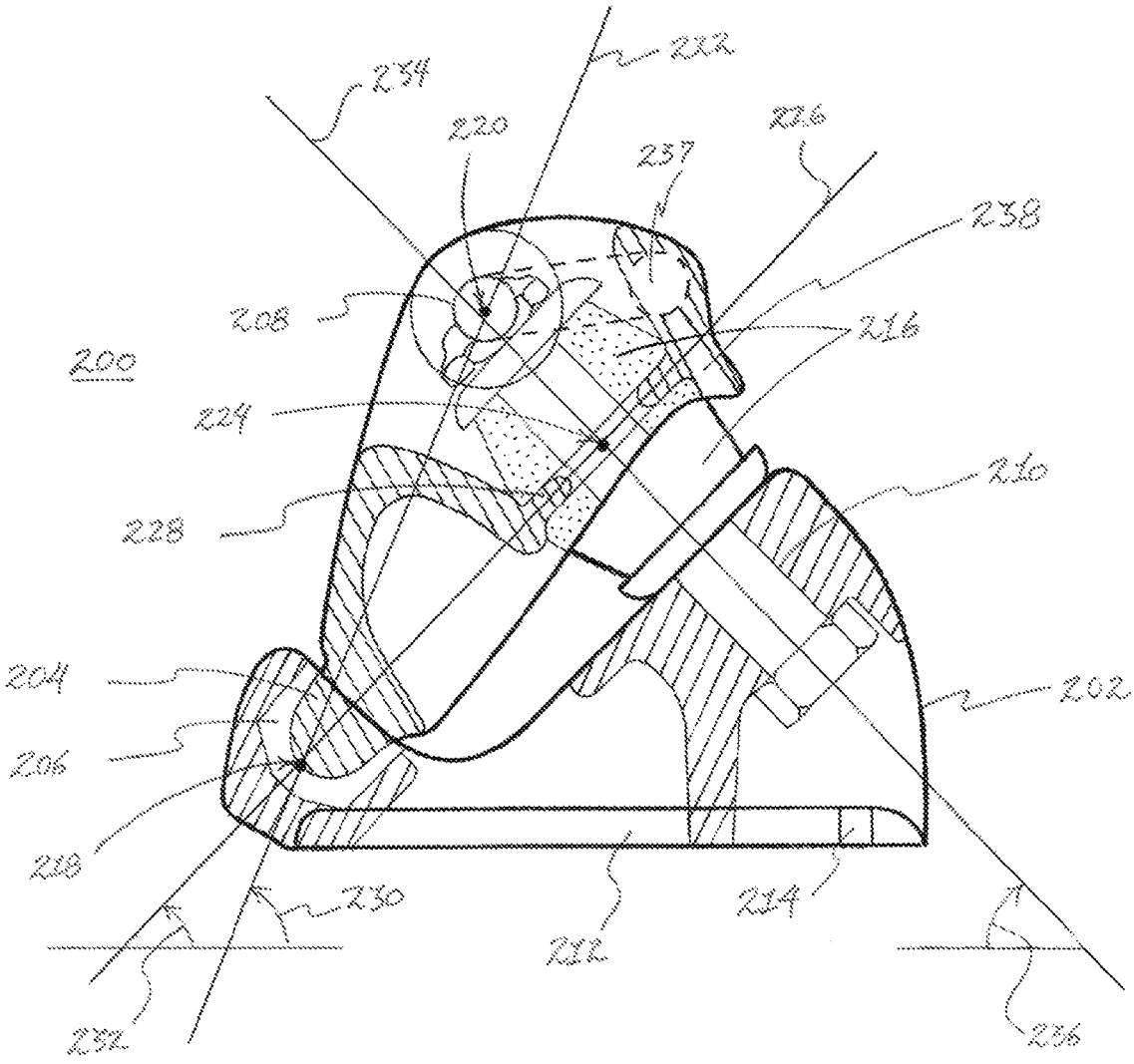
FIG. 2 is a cross-sectional view illustration of a truck according to the present invention.

A traditional skateboard truck 100 is to be contrasted with a skateboard truck 200 according to the present invention, as shown in FIG. 2. In the present invention, a skateboard truck 200 comprises a base plate 202 for attaching with a skateboard. A pivot pin 204 rests within a cup 206 of the base plate 202, pivotally coupling the pivot pin 204 with the base plate 202. A hanger 240 is coupled with the base plate 202 by a kingpin 21 0. The hanger 240 includes an axle pin 208 cast therein. The base plate 202 and hanger 240 are cast of any suitable construction and made of any suitably rigid material. As a non-limiting example, the base plate 202 and hanger 240 are cast in aluminum. In other aspects, the base plate 202 and hanger 240 may be cast in a formable high-strength metal or plastic.

The base plate 202 further comprises a base 212. The base 212 is formed in a suitable shape for attaching with a skateboard. As a non-limiting example, the base 212 is a substantially rectangular plate having a finite thickness, for example about 3/16 of an inch thick, and with a plurality of apertures 214. These apertures 214 are suitably configured for mounting the base plate 202 onto the underside of the skateboard platform.

The pivot pin 202 includes a tip 218 and the axle pin 208 includes a center point 220, such that a pin-to-axle axis 222 runs from the tip 218 of the pivot pin 204 to the center point 220 of the axle pin 208. Furthermore, the kingpin 210 has a midpoint 224, such that a pin-to-kingpin axis 226 runs from the tip 218 of the pivot pin 204 through the midpoint 224 of the kingpin 210. The kingpin 210 can be attached with the base plate 202 in a variety of ways and with a variety of bushings 216 to form the midpoint 224. The compliant properties of the bushings 216 allow the axle pin 208 to pivot about the pin-to-kingpin axis 226 when a sufficient load is applied to an end portion of the axle pin 208. As such, the axle pin 208 functions as a resilient pivoting member. Each of the pin-to-kingpin axis 226 and the pin-to-axle axis 222 are inclined at an angle relative to an attached skateboard deck. The pivot pin 204, axle pin 208 and base plate 202 are formed such that the angle of the pin-to-axle axis 222 (i.e., pin-to-axle angle 230) is greater than the angle of the pin-to-kingpin axis 226 (i.e., pin-to-kingpin angle 232) relative to an attached skateboard deck. As a non-limiting example, the pin-to-axle axis 222 is inclined to form the pin-to-axle angle 230 ranging from about 65 to 85 degrees, and the pin-to-kingpin angle 232 ranges from about 40 to 65 degrees. Additionally, the pivot pin 204, axle pin 208 and base plate 202 are formed such that the pin-to-kingpin axis 226 is substantially perpendicular to the kingpin axis 234 (i.e., the kingpin axis 234 runs through the length of the kingpin 210 and through the kingpin midpoint 224) while simultaneously allowing the axle pin center point 220 to substantially coincide with the kingpin axis 234. This is to be contrasted with the prior art skateboard truck, where the axle pin center point 114 cannot intersect the kingpin axis 118.

The kingpin 210 is positioned between the axle pin 208 and the pivot pin 204. A resilient bushing 216 is circumferentially disposed about the kingpin 210 for providing a skateboard truck pivot axis (i.e. the axis of rotation) relative to the axle pin 208. This configuration of pivot pin 204, the kingpin 210, and the axle pin 208 places the axle pin center point 220 directly in line with the kingpin 210 and perpendicular to the spring union (i.e., the resilient bushings 216), thus evenly dividing the load about the circumference of the resilient bushings 216 (which are held apart through annular projections 228).

The present invention has been devised that utilizes a pivot pin 202-kingpin 206 -axle pin 204 configuration (with an offset axle), with the kingpin axis 234 running substantially perpendicular to the pin-to-kingpin axis 226, while the pin-to-axle axis 222 is at a much steeper angle. This steeper angle increases the turning geometry of the truck while maintaining the perpendicular relationship between the pin-to-kingpin axis 226 and the kingpin axis 234. The perpendicular relationship enables the resilient bushings 224 to flex evenly around their circumference, while enabling the turning geometry to be increased. This novel relationship between the pin-to-kingpin axis 226 and the pin-to-axle axis 222 requires less force to deflect the bushings 216 while simultaneously increasing the turning geometry. This is to be contrasted with the prior art skateboard truck, where the difference between the pin-to-kingpin axis 226 and the pin-to-axle axis 222 is limited.

In order to increase the turning geometry (represented by the pin-to-axle axis 222), a kingpin axis angle 236 must also be increased (the kingpin axis angle 236 is formed between the kingpin axis 234 and a surface of a skateboard deck). However, increasing the kingpin axis angle 236 would limit the range of the resilient bushings 216, while decreasing the desired turning effect. The prior art has sought to solve this problem by splitting the axle pin into two halves, so that each half could be placed on either side of the kingpin, however, this weakens the part so much that it renders it weak and unsafe in use. The present invention solves this problem by bending the axle pin 204 around the kingpin 206, thus preserving structural integrity while allowing for an increase in turning geometry. This is depicted by the arched portion 237 that is shown as being offset from the center point 220 of the axle pin 204 and bent around the kingpin 206. Thus, as can be appreciated by one skilled in the art, the hanger 240 includes an arched axle pin 204 that is cast into the hanger 240.

Figure 3:
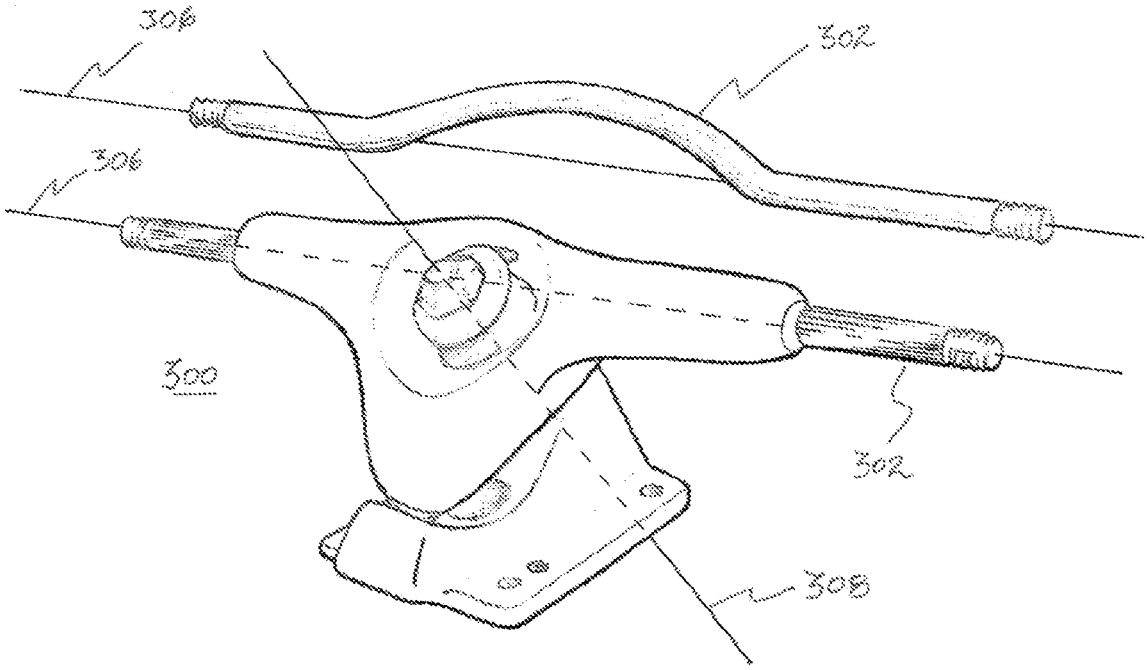
FIG. 3 is a front-view illustration of a truck according to the present invention, showing an arched axle as it is inside a cast part.

For further illustration, FIG. 3 is a front view of the skateboard truck 300 of the present invention. FIG. 3 first depicts the axle pin 302 as separate from the skateboard truck 300 to illustrate the arched portion 337 and that the axle pin 302 is bent (at the arched portion 337). FIG. 3 also depicts the axle pin 302 attached with the skateboard truck 300 and cast into or otherwise affixed with the hanger 340 to illustrate that the center axis 306 of the axle pin 302 passes through the center of the kingpin axis 308.

An impediment to the use of a bent axle pin has been in the difficulty of supporting the axle pin during the molding process. Because the arched portion of the axle pin 302 is cantilevered inside the mold, it needs a support to hold it in place. The present invention solves this problem by using a positive form. Referring again to FIG. 2, underneath the arched portion 237 of the axle pin 208 is a void 238 in the hanger casting. This void 238 is produced in the molding process by a positive form in the mold. The positive form serves to support the cantilevered arched portion 237 of the axle 208, thus enabling the axle pin 208 to be set into the mold and held in place during the casting process.

What is claimed is:

1. A skateboard truck with an offset axle, comprising:

a base plate;

a kingpin attached with the base plate;

a hanger with an axle pin therein, the hanger being attached with the base plate by the kingpin; and wherein the axle pin has a first end, a second end, a center axis extending between the first and second end, and an arched portion, the axle pin being positioned through the hanger such that the center axis of the axle pin passes through the kingpin, with the arched portion passing around the kingpin, thereby offsetting the axle pin and providing additional strength to the skateboard truck.

2. A skateboard truck as set forth in claim 1, wherein the hanger includes a pivot pin with a tip and the axle pin includes a center point, and wherein the kingpin includes a midpoint with a kingpin axis that runs lengthwise and through the midpoint, and wherein a pin-to-kingpin axis exists between the tip of the pivot pin and the midpoint of the kingpin, and wherein a pin-to-axle axis exists between the tip of the pivot pin and the center point of the axle pin; and wherein the base plate and hanger are formed such that when the hanger is attached with the base plate by the kingpin, the kingpin axis is substantially perpendicular to the pin-to-kingpin axis, while the pin-to-axle axis is substantially non-perpendicular to the kingpin axis.

3. A method for forming a skateboard truck with an offset axle, comprising acts of:

selecting a base plate;

attaching a kingpin with the base plate;

forming a hanger with an axle pin therein and attaching the hanger with the base plate by the kingpin; and wherein in forming the hanger with the axle pin, the hanger is formed such that the axle pin has a first end, a second end, a center axis extending between the first and second end, and an arched portion, the axle pin being positioned through the hanger such that the center axis of the axle pin passes through the kingpin, with the arched portion passing around the kingpin, thereby offsetting the axle pin and providing additional strength to the skateboard truck.

4. A method as set forth in claim 3, wherein the act of forming a hanger with an axle pin therein further comprises acts of:

using a positive form in a mold to support the arched portion of the axle pin; and casting the hanger with the with the axle pin therein.

* * * * *